US007461666B2

(12) United States Patent
Huang

(10) Patent No.: US 7,461,666 B2
(45) Date of Patent: Dec. 9, 2008

(54) AUTOMATIC DEVICE FOR OPENING OR CLOSING A MULTI-FOLDING UMBRELLA

(76) Inventor: Lucai Huang, Dongfen Precinct, Xinxu Town, Huizhou Guangdong (CN) 516223

( * ) Notice: Subject to any disclaimer, the term of this patent is extended or adjusted under 35 U.S.C. 154(b) by 450 days.

(21) Appl. No.: 11/344,264

(22) Filed: Jan. 31, 2006

(65) Prior Publication Data

US 2007/0028951 A1 Feb. 8, 2007

(30) Foreign Application Priority Data

Aug. 3, 2005 (CN) ..... 2005 2 0062592 U

(51) Int. Cl.
*A45B 25/16* (2006.01)

(52) U.S. Cl. ..... 135/22; 135/24

(58) Field of Classification Search ..... 135/22, 135/24, 15.1, 20.3, 23
See application file for complete search history.

(56) References Cited

U.S. PATENT DOCUMENTS 5,823,214 A * 10/1998 Seidel ..... 135/22
6,170,498 B1 * 1/2001 Wu ..... 135/24
6,684,893 B2 * 2/2004 Kuo ..... 135/24
2003/0000558 A1 * 1/2003 Chou ..... 135/15.1
2003/0168092 A1 * 9/2003 Chou ..... 135/22

FOREIGN PATENT DOCUMENTS

CN 01207334.2 3/2001

* cited by examiner

*Primary Examiner*—David Dunn
*Assistant Examiner*—Noah Chandler Hawk
(74) *Attorney, Agent, or Firm*—Morris, Manning & Martin LLP; Tim Tingkang Xia

(57) ABSTRACT

An automatic device for opening or closing multi-folding umbrella is provided, which comprises a umbrella shaft, a control handle, an upper and a lower nest, a rib assembly, a spring for closing, a spring for opening and a dragline in the shaft; a button with a reset spring and a snap convex is installed on the control handle and a rocker with a pushing spring can lock and release the step-cone; when the umbrella is closed, the snap convex of the button falls into the locking recess on the lower part of the upper tube; press the button, and it moves inwards but does not touch the rocker, the snap convex departs from the locking recess on the exterior wall of the upper tube and the umbrella is unfurled under the action of the spring for opening; press the button again, the step-cone is released, the spring for closing pulls the rib assembly to push downwards the lower nest back to the state of closing umbrella. The invented device increases the length space of the shaft to hold the spring for opening, therefore, it is especially suitable for the four-folding or five-folding automatic open and close umbrella.

10 Claims, 5 Drawing Sheets

AUTOMATIC DEVICE FOR OPENING OR CLOSING A MULTI-FOLDING UMBRELLA

FIELD OF THE INVENTION

The present invention generally relates to an umbrella, and more particularly, to a control device for opening and/or closing a multi-folding umbrella.

BACKGROUND OF THE INVENTION

Referring first to FIG. 1, a currently available automatic open and close device 10 of a multi-folding umbrella is shown, which can be folded by pressing the closing control device to control a rib assembly 4 that is centered between an upper nest 2 and a lower nest 3, for example, as disclosed in the applicant's Chinese patent No. 01207334.2 entitled "Gnarled Closing Control Device for Automatic Open and Close Umbrella." which is incorporated herein by reference for background information only. The control device 10 has a button 92 slideably received in a control handle 9, when the umbrella shaft is in the state of compression after the umbrella is closed, the ring extended from the middle of the button 92 buckles a notched groove of the lower nest 3 inside of the control handle 9, presses the ring of the button 92 for the first time to release the lower nest 3, which makes the spring for opening 7 in the shaft raise the lower nest 3 to open the umbrella; when the button is pressed for the second time, the closing control sleeve has been hoisted, aiming at the pushing column for closing on the closing control sleeve, the convex body of the button pushes the step-cone 81 that is buckled in the control seat for closing to its center and departs from the fastening, so as to release the tight dragline 8 to close the umbrella. The device possesses the two-stage controlling functions of opening and closing as shown in FIG. 1.

The conventionally automatic open and close device of a three-folding umbrella as described above has the following deficiencies:

1. When the shaft is in the state of compression, the step-cone fastened on the control seat for closing is positioned on the upper part inside of the control handle, and the lower end of the spring for opening is also on the upper part, which causes the small length space in the shaft to hold the spring for opening, the spring for opening will not have enough elasticity due to the limitation of length if the automatic open and close multi-folding umbrella is four-folding or five-folding, therefore, the existing device for opening and closing is hard to be applied to the four-folding or five-folding automatic umbrella; and 2. The device for opening or closing multi-folding umbrella with the existing technique requires a lot of parts, which not only have complicate structures, but also require complicate machining process for manufacturing, and there result in high costs. Moreover, the controlling button of the device works only when it is pressed with strong force.

Therefore, a heretofore unaddressed need exists in the art to address the aforementioned deficiencies and inadequacies.

SUMMARY OF THE INVENTION

In one aspect, the present invention relates to an automatic opening or closing device with simple structure which can be applied to four-folding or five-folding umbrella possessing the shaft with two segments or three segments.

The present invention is more particularly described in the following exemplary embodiments. In one embodiment, a device for automatic open and close multi-folding umbrella comprises: an umbrella shaft that has a lower tube, a middle tube of one segment or more segments and a upper tube which are muff-coupled in turn, a controlling handle and an upper nest that are fixed on the bottom of the lower tube and the top of the upper tube respectively, a lower nest that is sleeved on the exterior of the upper tube glidingly, a rib assembly that is centered between the upper nest and the lower nest, a spring for closing tied to the rib assembly, a raising inner tube that is encased in the umbrella shaft, a spring for opening that is slided outside of the raising inner tube but inside of the umbrella shaft, and a dragline adapted for tensing the lower nest and preventing it from sliding downwards when the umbrella is open, the dragline circled on assembly pulleys of the upper nest and the lower nest, wherein one end of the dragline is fixed on the upper nest and the other end the dragline is tied to the step-cone through the raising inner tube.

It is an object of the present invention to improve the structure of the controlling handle.

The bottom of a handle body of the control handle and the bottom of the lower tube are fixedly joined together, a button hole is defined on the sidewall of the upper part of the handle body, and the button with the reset spring and the snap convex is installed in the button hole, a rocker that is hinged with the handle body under the button hole and also equipped with the push spring lock or release the step-cone that is tied to the end of the dragline, and a movable ring with a lifting spring is around the upper part of the rocker and the lower part of the lower tube;

When the umbrella is closed, the shaft is in the state of compression, the snap convex of the button falls into the locking recess on the lower part of the upper tube, the movable ring is forced downwards by the bottom of the middle tube and staggers with the button, and the rocker locks the step-cone that is tied to the dragline;

When the button is pressed, the button moves inwards but does not touch the rocker and the snap convex departs from the locking recess on the lower part of the upper tube, and the umbrella is then unfurled under the action of the opening spring, the step-cone is still locked by the rocker so as to tighten the dragline to prevent the lower nest from sliding downwards, and the movable ring moves upwards to the position that is touched by the button under the action of the lifting spring.

When the button is pressed again, the button pushes the movable ring inwards and drives the rocker to rotate to release the step-cone, so the lower nest loses support and the closing spring pulls the rib assembly to push the lower nest downwards back to the state of closing umbrella.

Compared with the conventional devices, the present invention has the following advantages.

The rocker that locks or releases the step-cone is located on the lower part of the control handle, which occupies a small portion of the space of the interior lower tube of the shaft, thereby increasing the space for receiving the opening spring in the shaft. Accordingly, the number of coils of the opening spring can be increased to 20-30, thereby increasing the elasticity of the opening spring that is necessary for a four-folding or five-folding automatic opening and closing umbrella.

The number of parts of the control handle is reduced, and its structures are simple. Therefore, production costs are reduced. Additionally, the opening and closing umbrella is easy to operate.

DETAILED DESCRIPTION OF THE INVENTION

Figure 1:
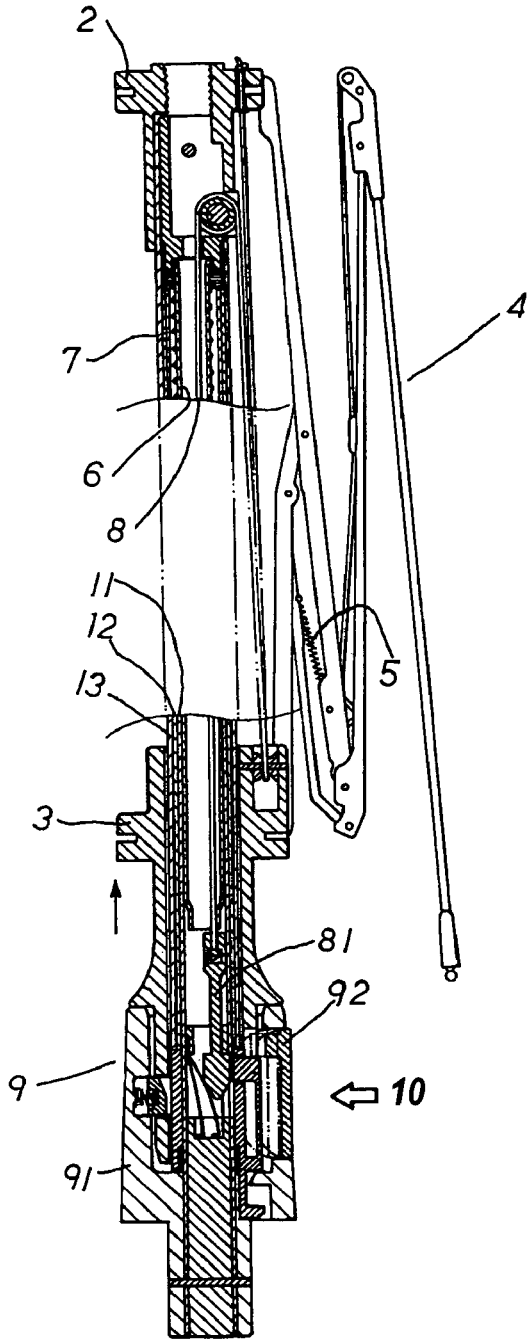
Fig. 1 (Related Art)
FIG. 1 shows a cross sectional view of a conventionally automatic device for opening and closing multi-folding umbrella where the umbrellas is closed and the shaft is in the state of compression.
Figure 2:
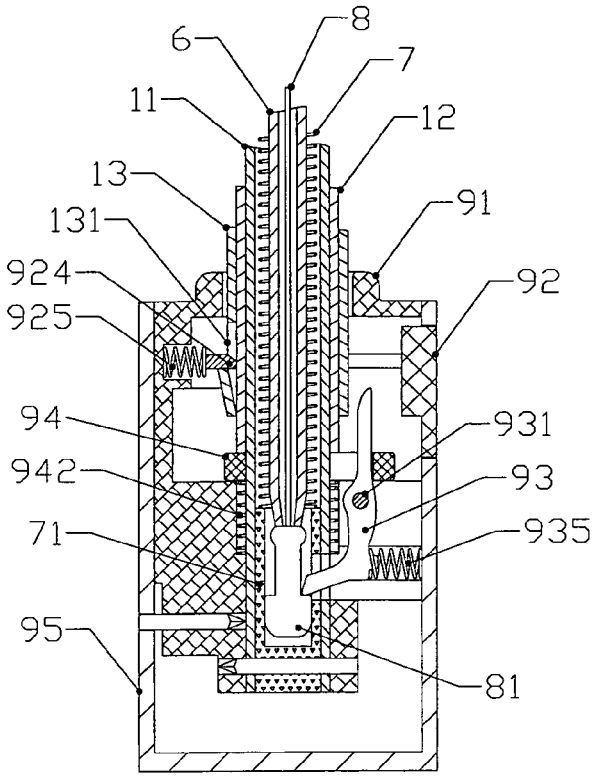
FIG. 2 shows a cross sectional view of a control handle 9 of an automatic device for opening and closing multi-folding umbrella according to one embodiment of the present invention, where the umbrella is closed and the shaft is in the state of compression.

Embodiments of the present invention are described in conjunction with the accompanying drawings of FIGS. 2-8 as follows:

Referring to FIG. 2, an automatic device for opening and/or closing multi-folding umbrella is shown according to one embodiment of the present invention. The automatic device includes an umbrella shaft that has a lower tube 11, a middle tube 12 having one segment or more segments, and an upper tube 13. The lower tube 11, the middle tube 12 and the upper tube 13 are muff-coupled in turn. The automatic device also includes a control handle 9 that is fixed on the bottom of the lower tube 11, a raising inner tube 6 that is encased in the umbrella shaft, a opening spring 7 that is adapted for opening the umbrella and is slided in between the exterior of the raising inner tube and the interior of the umbrella shaft. The automatic device further includes a dragline 8 that is used to tense the lower nest 3 so as to prevent it from sliding downwards when the umbrella is opened, where one end of the dragline 8 is tied to the step-cone 81 through the raising inner tube 6. As shown in FIG. 2, the automatic device has an upper nest 2 fixed on the top of the upper tube 13, a lower nest 3 sleeved glidingly on the exterior of the upper tube 13, and a closing spring 5 that is adapted for closing the umbrella and is tied to a rib assembly 4 that is centered between the upper nest 2 and the lower nest 3 (referring to FIG. 1). The other end of the dragline 8 is tied to a dragline fixing hole defined on the top of the upper nest 2 by circling the dragline 8 round a set of assembly pulleys through the top of upper tub 13, where the set of assembly pulleys are fixed on the upper nest 2 and the lower nest 3. In the set of assembly pulleys, two pulleys are mounted on the upper nest 2, where one is a rewinding pulley mounted on two line-channels on the side of the top of the upper nest 2, i.e., a notch cut on the top of the upper nest 2, and the other is a guiding pulley placed on the inner pulley seat on the upper part of the upper nest 2 by two line-channels, where one line-channel is positioned on the central line of the top of the upper nest 2 and the other is located under the rewinding pulley. The set of assembly pulleys has another two pulleys, an upper rewinding pulley and a lower rewinding pulley, mounted on the side of the lower nest 3, where their channels are all on the lateral side of the lower nest 3. These foresaid structures are generally the same as the existing technique and the invention is mainly to improve the shape and structure of the control handle 9.

As shown in FIG. 2, a bushing 911 in the lower part of the handle body 91 of the control handle 91 is spliced with the lower tube 11 and secured with a pin. A button hole is cut on the sidewall of the upper part of the handle body 91. A button 92 with a reset spring 925 and a snap convex 924 is received in the button hole. The rocker 93 having a push spring 935 and connected with the handle body 91 from the underneath of the button hole is adapted for locking and/or releasing the step-cone 81 that is connected to the end of the dragline 8. The movable ring 94 with the lifting spring 942 is located below a button-guide groove 913 in a cavity 912 defined in the handle body 91 and around the upper part of the rocker 93 and the lower part of the lower tube, where the lifting spring 942 is pre-compressed under the movable ring 94. The locking recess 131 on the exterior wall of the upper tube 13 is formed by stamping and its lower margin appears the inclined plane that slightly protrudes from the wall of the upper tube, which makes the lower end of the upper tube 13 enter the ring 922 of the button 92 easily when the shaft is compressed after the umbrella is closed. The seat of opening spring 71 is mounted inside of the bottom of the lower tube 11 in which the step-cone 81 can be slided up and down freely. A slot is opened on the sidewall of the seat of opening springing 71 and the lower tube 11, which is used for the rocker 93 to extend to the seat of opening spring 71 to lock the step-cone 81.

Figure 3:
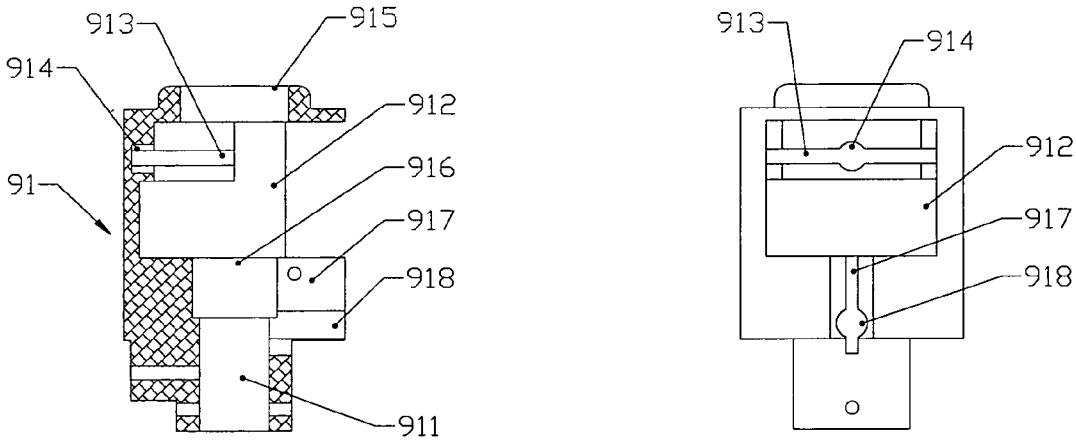
FIG. 3 shows views of a handle body 91 of the control handle 9 shown in FIG. 2: (a) a front view, and (b) a right side view.

The structure of the handle body 91 is shown in FIG. 3. The handle body 91 includes the bushing 911 on the lower portion of the handle body 91, where the bushing 911 is spliced with the bottom of the lower tube 11. The cavity 912 is defined by the sidewall of the upper part for receiving the button 92. The button-guide groove 913 is located on the inner wall corresponding to the button hole. In the bottom of the center of the guide groove a seat 914 is adapted for the reset spring 925. An aperture 915 with a diameter greater than the radial size of the lower part of the upper tube 13 is placed on the top of the handle body 91. A seat of the lifting spring 916 is mounted on its middle part. As shown in FIG. 3, a through groove 917 is formed below the button hole for receiving and holding the rocker 93 hinged on the handle body 91 such that the rocker 93 is swingable from one side to another side. A seat 918 of the pushing spring 935 is mounted in the through groove 916.

Figure 4:
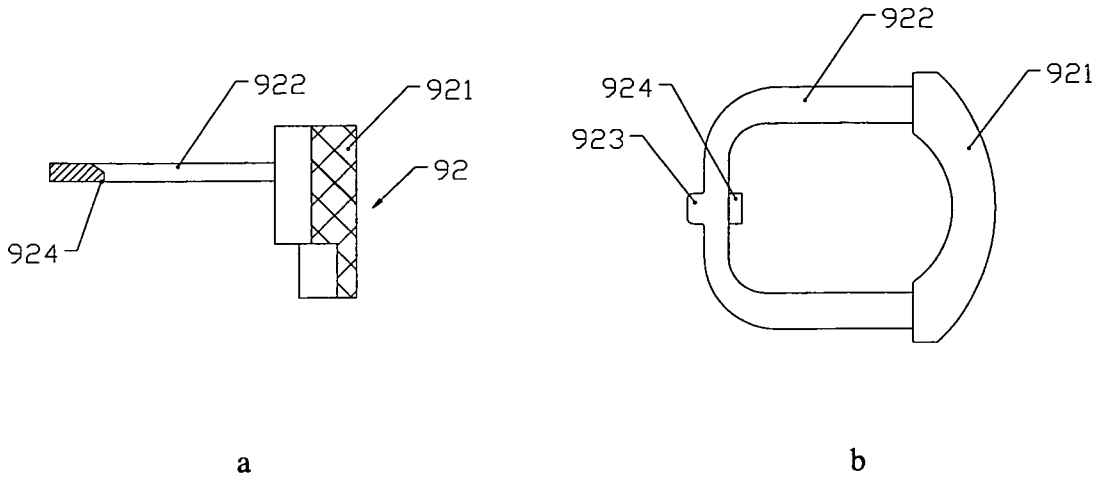
FIG. 4 shows views of a button 92 of the control handle 9 shown in FIG. 2: (a) a front view, and (b) a top view.

The button 92 has a tabular body 921 having the same radian as the exterior wall of the handle body 91, the middle part of which extends inwards to form the ring 922, a bulge 923 joined the reset spring is equipped on the exterior wall of the ring on the bottom of the button 92 and the snap convex 924 is set in the interior wall of the ring on the bottom of the button 92, as shown in FIG. 4.

Figure 5:
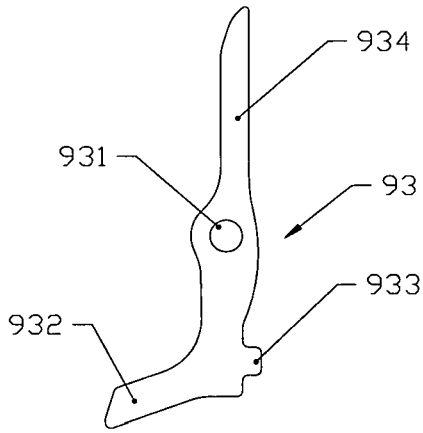
FIG. 5 shows a cross sectional view of a rocker 93 of the control handle 9 shown in FIG. 2.

The middle part of the rocker 93 is articulated in the through groove 916 on the handle body 91 by the pin 931, the flange 932 that locks the step-cone 81 is positioned on the inner edge of the lower part of the rocker and a bulge 933 scarfed the pushing spring is positioned on the outer edge of its lower part, and on its upper part is there the swing arm 934 sleeved by the movable ring 94 glidingly, as shown in FIG. 5.

Figure 6:
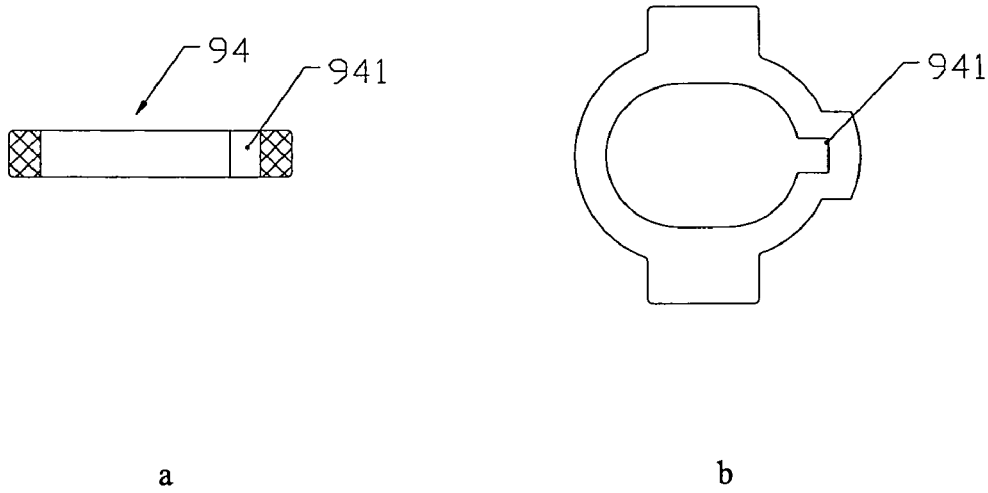
FIG. 6 shows views of a movable ring 94 of the control handle 9 shown in FIG. 2: (a) a front view, and (b) a top view.

The inner hole of the movable ring 94 appears the elongated form that is consistent with the moving direction of the button 92 and a notch 941 is opened in one end of the elongated hole, which can hold the swing arm 934 of the rocker 93, as shown in FIG. 6.

The following is the brief description of the operational principle of the invention.

After the umbrella is closed and the shaft is in the state of compression, the snap convex 924 of on the button 92 falls into the locking recess 131 on the lower part of the upper tube 13, therefore, the upper tube 13 is locked to maintain the shaft in the state of compression, when the movable ring 494 is forced downwards by the bottom of the middle tube 12 and staggers with the button 92 but the rocker 93 still locks the step-cone 81 tied to the dragline 8.

Figure 7:
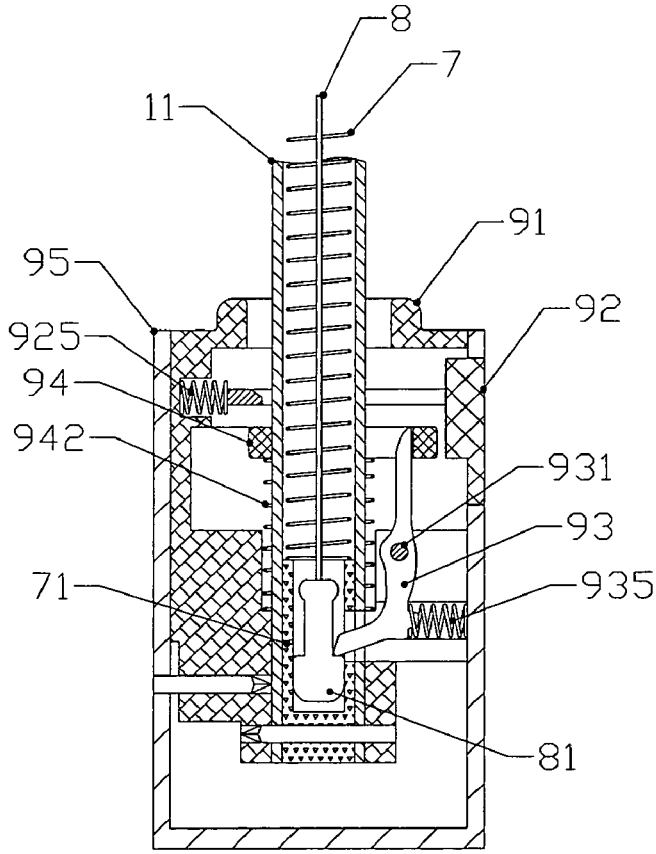
FIG. 7 shows a cross sectional view of the control handle 9 shown in FIG. 2, where the button is released for opening the umbrella.

When button 92 is pressed for the first time, it moves inwards but that does not touch the rocker 93 because the movable ring 94 staggers with the button 92, the snap convex 924 departs from the locking recess 131 on the lower part of the upper tube 13, namely, the shaft is not locked and the umbrella is unfurled under the action of the spring for opening 7, the step-cone 81 is still locked by the rocker 93 so as to strain the dragline 8 to prevent the lower nest 3 from sliding downwards; but the movable ring 94 moves upwards to the position that the button 92 can touch under the action of the lifting spring 942, as shown in FIG. 7.

Figure 8:
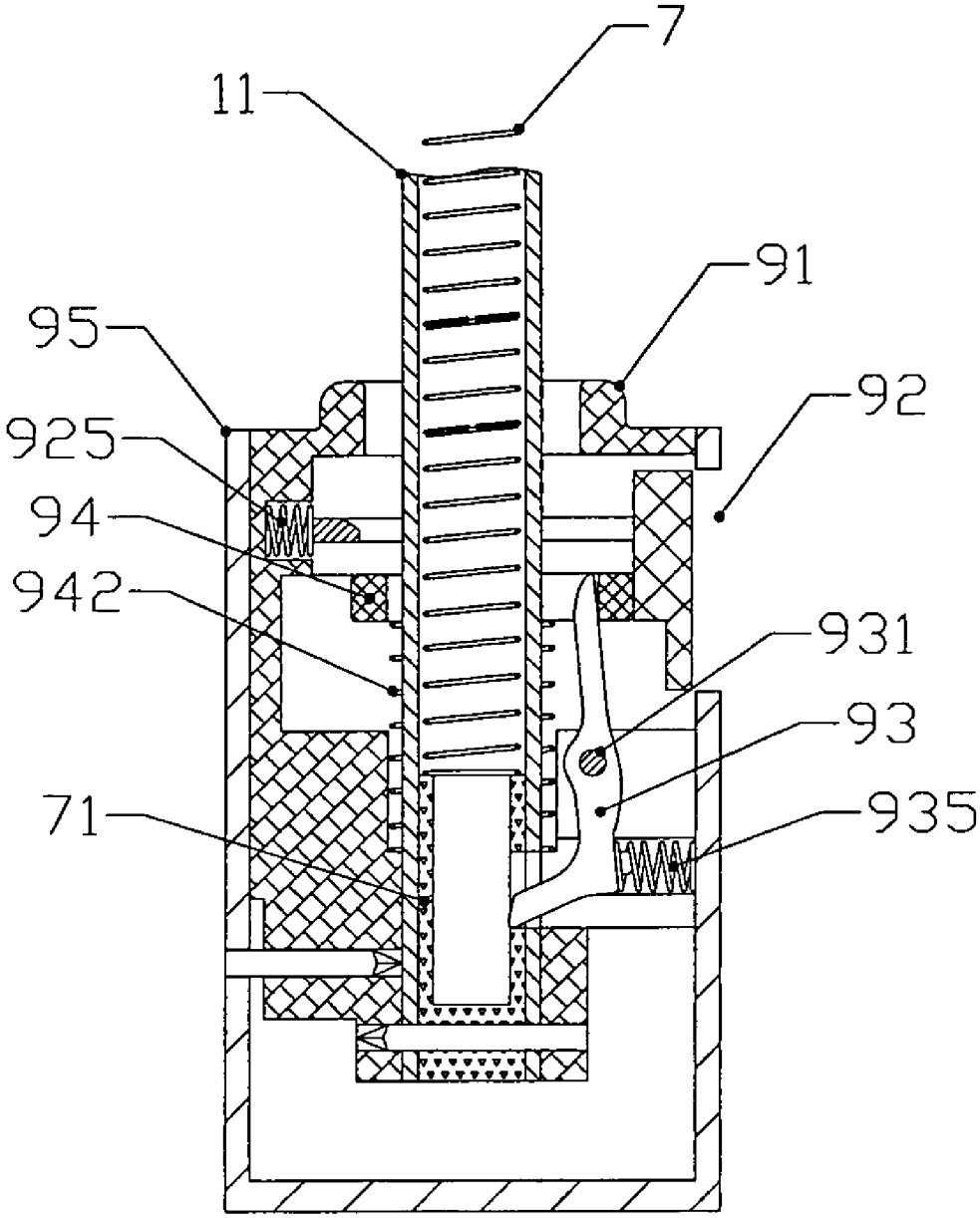
FIG. 8 shows a cross sectional view of the control handle 9 shown in FIG. 2, where the button is pressed for closing the umbrella.

When the button 92 is pressed again, it will push the movable ring 94 inwards, which drives the rocker 93 to rotate, consequently, the step-cone 81 is released, the lower nest 3 slides downwards for the loss of support and the spring for closing 5 pulls the rib assembly 4 to push the lower nest 3 downwards back to roll up the umbrella, as shown in FIG. 8.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An automatic device for opening or closing multi-folding umbrella, comprising:

an umbrella shaft that contains a lower tube (11), a middle tube (12) with one segment or more segments and a upper tube (13), adapted such that the lower tube (11) is received in the middle tube (12), and the middle tube (12) is in turn received in the upper tube (13), a control handle (9) and an upper nest (2) that are fixed on the bottom of the lower tube (11) and on the top of the upper tube (13) respectively, a lower nest (3) that is sleeved glidingly on the exterior of the upper tube (13), a rib assembly (4) that is centered between the upper nest (2) and the lower nest (3), a spring for closing (5) tied to the rib assembly (4), a raising inner tube (6) that is encased inside of the umbrella shaft, a spring for opening (7) that is slided outside of the raising inner tube (6) but inside of the shaft, a dragline (8) that is used to tense the lower nest (3) and prevent it sliding downwards when the umbrella is open, the dragline (8) is circled on the assembly pulley of the upper nest (2) and lower nest (3), whose one end is fixed on the upper nest (2) and the other end is tied to a step-cone (81) through the raising inner tube (6); it is characterized in that:

the bottom of the handle body (91) of the said control handle (9) is joined fixedly with the bottom of the lower tube (11), a button hole is provided on the sidewall of the upper part of the handle body (91), and a button (92) with a reset spring (925) and a snap convex (924) is installed in the button hole, a rocker that is hinged with the handle body (91) under the button hole and also equipped with the push spring (935) lock or release the step-cone (81) that is tied to the end of the dragline (8), and a movable ring (94) with the lifting spring (942) is around the upper part of the said rocker (93) and the lower part of the lower tube;

wherein after the umbrella is closed and the shaft is in the state of compression, the snap convex (924) of the said button (92) falls into the locking recess (131) on the lower part of the upper tube (13), the said movable ring (94) is forced downwards by the bottom of the middle tube (12) and staggers with the button (92), and the said rocker (93) locks the step-cone (81) that is tied to the dragline (8);

when the said button (92) is pressed, it will move inwards but will not touch the rocker (93) and the said snap convex (924) will depart from the locking recess (131) on the lower part of the upper tube (13), and the umbrella will be unfurled under the action of the spring for opening (7), the said step-cone (81) is still locked by the rocker (93) so as to tighten the said dragline (8) to prevent the lower nest (3) from sliding downwards, and the movable ring (94) moves upwards to the position that can be touched by the button (92) under the action of lifting spring (942);

when the button (92) is pressed again, it will push the movable ring (94) inwards and drive the said rocker (93) to rotate to release the step-cone (81), so the said lower nest (3) loses support and the spring for closing (5) pulls the rib assembly (4) to push the lower nest (3) downwards back to the state of closing umbrella.

2. The automatic device for opening or closing multi-folding umbrella according to claim 1, is characterized in that: the lower part of the said handle body (91) has a bushing (911) that can be spliced with the bottom of the lower tube (11), and a cavity (912) is provided on the side wall of its upper part, which can hold the button (92), a button guide groove (913) is positioned in the inner wall that is corresponding to the button hole, on the bottom of the center of the guide groove is a seat of the reset spring (914) disposed, an aperture (915) whose diameter is bigger than the radial size of the lower part of the upper tube (13) is placed on the top of the handle body (91), a seat of the lifting spring (916) is mounted on its middle part, a through groove (917) is opened below the button hole, which can hold the through groove (917) that can allow the rocker (93) hinged on the handle body (91) to swing from side to side, and a seat (918) of the push spring (935) is mounted in the through groove (916).

3. The automatic device for opening or closing multi-folding umbrella according to claim 1 or claim 2, is characterized in that: the said step-cone (81) can slide up and down freely in the seat of opening spring (71) that is fixed inside of the bottom part of the lower tube (11), and on the said seat of opening spring (71) and the sidewall of the lower tube (11) is provided a slot, which can be used for the rocker (93) to extend into the seat of opening spring (71) to lock the said step-cone (81).

4. The automatic device for opening or closing multi-folding umbrella according to claim 1 or claim 2, is characterized in that: the said button (92) has a tabular body (921) that has the same radian as the exterior wall of the handle body (91) and the middle part of the tabular body extends inwards to form a ring (922), the bulge (923) joining the reset spring (925) is equipped on the exterior wall of the ring on the bottom of the button (92), the said snap convex (924) is mounted in the interior wall of the ring at the bottom of the button (92).

5. The automatic device for opening or closing multi-folding umbrella according to claim 1 or claim 2, is characterized in that: the middle part of the rocker (93) is articulated in the through groove (916) on the handle body (91) by the pin (931), a flange (932) that locks the step-cone (81) is equipped on the inner edge of the lower part of the rocker, and a bulge (933) rabbeted the push spring (935) is positioned on the outer edge of its lower part, and its upper part is the swing arm (934) joined with the movable ring (94) glidingly.

6. The automatic device for opening or closing multi-folding umbrella according to claim 1 or claim 2, is characterized in that : the said movable ring (94) is located under the button guide groove (913) in the cavity (912) on the handle body (91) and also sleeved glidingly on the lower tube (11), the inner hole of the movable ring (94) appears elongated forming that is consistent with the moving direction of the button (92), one end of the elongated hole has a notch (941) that can hold the swing arm (934) of the rocker (93) and the lifting spring (942) is pre-compressed under the movable ring (94).

7. The automatic device for opening or closing multi-folding umbrella according to claim 1 or claim 2, is characterized in that: the locking recess (131) on the exterior wall of the said upper tube (13) is formed by stamping, and its lower margin appears the inclined plane outward protrusion slightly that slightly protrudes from the wall of the upper tube.

8. The automatic device for opening or closing multi-folding umbrella according to claim 1, is characterized in that: the said umbrella is four-folding or five-folding umbrella and the said shaft (12) is two segments or three segments.

9. The automatic device for opening or closing multi-folding umbrella according to claim 1, is characterized in that :one end of the said dragline (8) is tied to the upper nest (2) after having rounded the double assembly pulley fixed on the upper nest (2) and the lower nest (3) through the top of the upper tube (13), two pulleys are positioned on the upper nest (2), wherein, one is the rewinding pulley that is mounted in the hole on the top of the upper nest (2) and whose two channels are positioned on the side of the top of the upper nest (2), the other is the guide pulley that is placed on the pulley seat in the upper part of the upper nest (2), one channel of which is at the central line of the upper nest (2) and the other one is under the rewinding pulley.

10. The automatic device for opening or closing multi-folding umbrella according to claim 9, is characterized in that: on the side of the said lower nest (3) are provided the upper and lower rewinding pulleys whose channels are on the side of the lower nest (3).

* * * * *